US005957348A

United States Patent [19]

Foreman

[11] Patent Number: 5,957,348

[45] Date of Patent: Sep. 28, 1999

[54] DRINKING TUBE SUPPORT FOR BEVERAGE DISPENSER

[76] Inventor: Michael H. Foreman, 623 Mcleod St., Livermore, Calif. 94550

[21] Appl. No.: 09/006,317

[22] Filed: Jan. 13, 1998

[51] Int. Cl.[6] ..... A45F 3/16

[52] U.S. Cl. ..... 224/148.1; 224/148.2; 224/647; 224/680

[58] Field of Search ..... 224/148.2, 148.1, 224/148.4, 148.5, 148.6, 148.7, 647, 680, 627; 222/175; 248/302, 303, 112; 24/131 C, 3.1, 11 C

[56] References Cited

U.S. PATENT DOCUMENTS

| | | | |
|---|---|---|---|
| 103,300 | 5/1870 | Chapin | 239/33 |
| 639,429 | 12/1899 | Nutter | 224/627 |
| 745,551 | 12/1903 | Abercrombie | 24/131 C |
| 2,460,542 | 2/1949 | Smith | 65/65 |
| 2,557,411 | 6/1951 | Butsch | 299/172 |
| 4,526,298 | 7/1985 | Boxer et al. | 222/130 |
| 5,060,833 | 10/1991 | Edison et al. | 224/148 |
| 5,207,719 | 5/1993 | Janus | 224/148 |
| 5,301,856 | 4/1994 | Hollander | 224/148.2 |
| 5,301,858 | 4/1994 | Hollander | 224/148 |
| 5,484,405 | 1/1996 | Edstrom, Sr. | 604/77 |

*Primary Examiner*—Stephen P. Garbe
*Assistant Examiner*—Maerena W. Brevard
*Attorney, Agent, or Firm*—Jack Lo

[57] ABSTRACT

A drinking tube support for a beverage dispenser includes a bendable wire formed into a loop at a lower portion and a spiral at an upper portion. The beverage dispenser includes a beverage container secured on the back of a user by shoulder straps, and a drinking tube extending from the container. The drinking tube is secured to one of the shoulder straps by a clip. The drinking tube support is attached to the beverage dispenser by positioning the loop under and around the clip. The free end of the drinking tube is inserted through the spiral. An intermediate portion of the drinking tube support is long enough to enable the wire to be adjusted to position the free end of the drinking tube near the mouth of the user, who can conveniently drink by simply turning the head slightly, without having to pick up the tube. In a second embodiment, the drinking tube support includes a wire with a lower end attached to a base member, and an upper end formed into a spiral. A pair of clasps attached to the base member are clamped around the drinking tube adjacent the clip on the strap. The upper end of the drinking tube is inserted through the spiral, and the intermediate portion of the wire is adjusted to position the free end of the drinking tube near the mouth of the user. In a third embodiment, a retaining strap is provided for attaching the drinking tube to a shoulder strap of a beverage dispenser without a drinking tube clip.

3 Claims, 3 Drawing Sheets

DRINKING TUBE SUPPORT FOR BEVERAGE DISPENSER

BACKGROUND OF THE INVENTION

1. Field of the Invention

This invention relates generally to supporting devices for positioning a drinking tube near the mouth of a user.

2. Prior Art

A beverage dispenser sold as the "CAMEL BACK" is shown in U.S. Pat. No. 5,060,833 to Edison et al. It includes a beverage container strapped onto the back of a user, and a flexible drinking tube extending from the container. However, the drinking tube is merely draped over the shoulder, so that the user must pick up the tube and position its end in the mouth. If the dispenser is used when riding a bicycle, picking up the tube requires removing one hand from the handlebar, which disrupts cycling rhythm and concentration.

U.S. Pat. No. 103,300 to Chapin shows a wire clip for supporting a straw on the rim of a cup. It includes a coil spring at one end for clipping onto the rim of a cup, and another coil spring at an opposite end for wrapping around the straw. However, the connection between the springs is so short that it cannot be adjusted to position the straw at different heights and angles. Further, the clip is a spring, which cannot be easily bent. U.S. Pat. No. 2,460,542 to Smith shows a wire clip that includes a semi-circular brace for holding a straw against a cup. It also cannot be adjusted. U.S. Pat. No. 2,557,411 to Butsch shows a zigzagging wire clip for supporting a straw. It includes semi-circular loops for holding a straw. U.S. Pat. No. 5,484,405 to Edstrom, Sr. shows a drinking tube with a stiffener wire attached in parallel. None of the prior art drinking tube supports includes provisions for easily retrofitting to the "CAMEL BACK" or other beverage dispensers.

OBJECTS OF THE INVENTION

Accordingly, objects of the present invention are:

to support a drinking tube of a beverage dispenser near the mouth of a user, so as to eliminate the need to pick up the drinking tube;

to be adjustable for optimizing the position of the drinking tube; and to be easily retrofitted to the beverage dispenser by a user.

Further objects of the present invention will become apparent from a consideration of the drawings and ensuing description.

BRIEF SUMMARY OF THE INVENTION

A drinking tube support for a beverage dispenser includes a bendable wire formed into a loop at a lower portion and a spiral at an upper portion. The beverage dispenser includes a beverage container secured on the back of a user by straps, and a drinking tube extending from the container. The drinking tube is secured to one of the straps by a clip. The drinking tube support is attached to the beverage dispenser by positioning the loop under and around the clip. The free end of the drinking tube is inserted through the spiral. An intermediate portion of the drinking tube support is long enough to enable the wire to be adjusted to position the free end of the drinking tube near the mouth of the user, who can conveniently drink by simply turning the head slightly, without having to pick up the tube. In a second embodiment, the drinking tube support includes a wire with a lower end attached to a base member, and an upper end formed into a spiral. A pair of clasps attached to the base member are clamped around the drinking tube adjacent the clip on the strap. The upper end of the drinking tube is inserted through the spiral, and the intermediate portion of the wire is adjusted to position the free end of the drinking tube near the mouth of the user. In a third embodiment, a retaining strap is provided for attaching the drinking tube to a shoulder strap of a beverage dispenser without a drinking tube clip.

Figure 1:
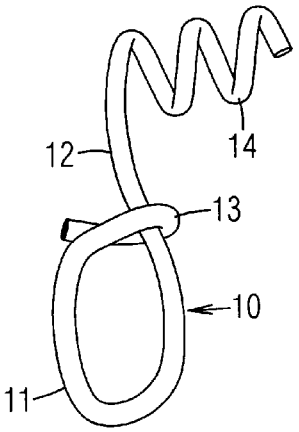
FIG. 1 is a front view of a first embodiment of the present drinking tube support for beverage dispenser.

| DRAWING REFERENCE NUMERALS | |
|---|---|
| 10. Wire | 11. Loop |
| 12. Intermediate Portion | 13. Hook |
| 14. Coil | 15. Beverage Dispenser |
| 16. Beverage Container | 17. Shoulder Straps |
| 18. Drinking Tube | 19. Clip |
| 20. Wire | 21. Clasps |
| 22. Base Member | 23. Coil |
| 24. Snaps | 25. Intermediate Portion |
| 26. Resilient Pad | 27. Retaining Strap |

DETAILED DESCRIPTION OF THE INVENTION

FIGS. 1–2:

A first embodiment of the present drinking tube support is shown in the front view in FIG. 1. It comprises a wire 10 with a lower portion bent into a loop 11. A corresponding end of wire 10 is bent around an intermediate portion 12 of wire 10 into a hook 13 for securing loop 11. An upper end of wire 10 is formed into a coil 14. Wire 10 is preferably comprised of a bendable wire which stays in any selected position.

Figure 2:
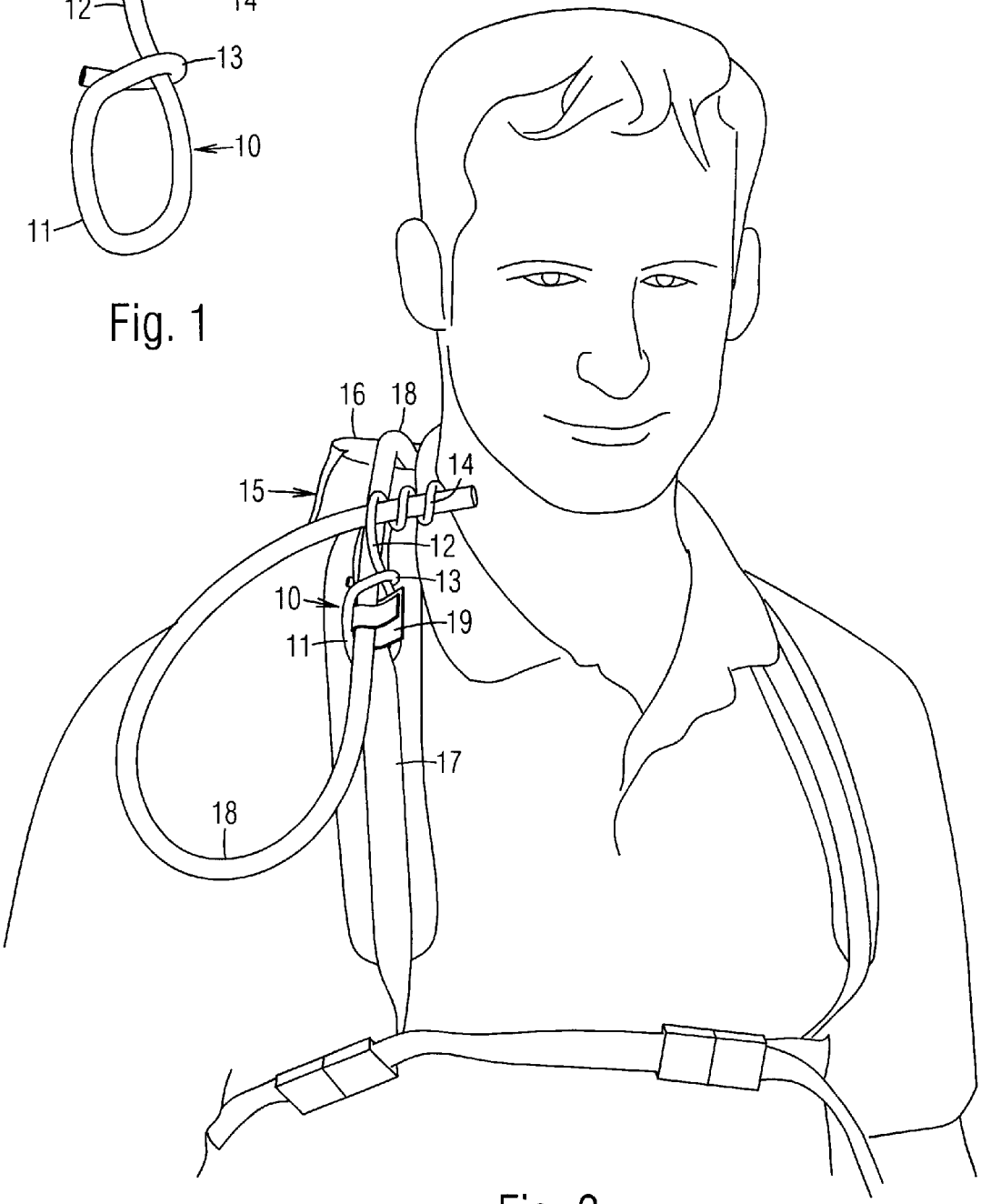
FIG. 2 is a front view of the drinking tube support attached to a beverage dispenser.

As shown in FIG. 2, the drinking tube support is attached to a conventional beverage dispenser 15, which in this example is the "CAMEL BACK." Dispenser 15 includes a beverage container 16 secured on the back of a user by shoulder straps 17, and a drinking tube 18 extending from the top of container 16. Tube 18 is secured to one of shoulder straps 17 by a clip 19. The drinking tube support is attached to dispenser 15 by unwrapping hook 13 and opening loop 11. The lower end of wire 10 is threaded under and around clip 19, and hook 13 is reattached around intermediate portion 12 to close loop 11 around clip 19. The free end of drinking tube 18 is inserted through coil 14 of wire 10. Intermediate portion 12 is adjusted by bending until the end of drinking tube 18 is positioned near the mouth of the user. Intermediate portion 12 is preferably long enough to enable drinking tube 18 to be adjusted through a wide range of positions. Drinking tube 18 is thus positioned to enable the user to conveniently drink simply by turning the head slightly, without having to pick up drinking tube 18.

Figure 3:
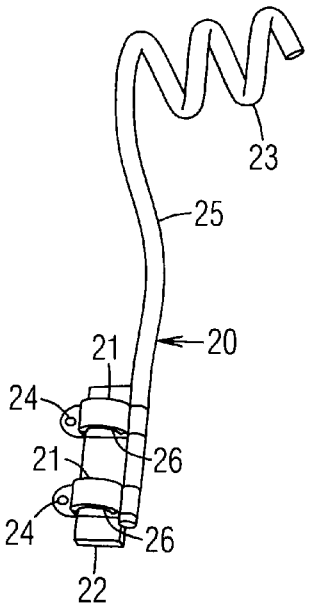
FIG. 3 is a front view of a second embodiment of the drinking tube support.

FIGS. 3–4:

A second embodiment of the drinking tube support is shown in the front view in FIG. 3. It comprises a bendable wire 20 with a lower portion attached to a pair of clasps 21, which are attached on top of a flexible base member 22. A resilient pad 26, preferably felt, is attached to the inside of each clasp 21. An upper end of wire 20 is formed into a coil 23. Clasps 21, which are preferably plastic, are closed with snaps 24. Wire 20 includes a long intermediate portion 25.

Figure 4:
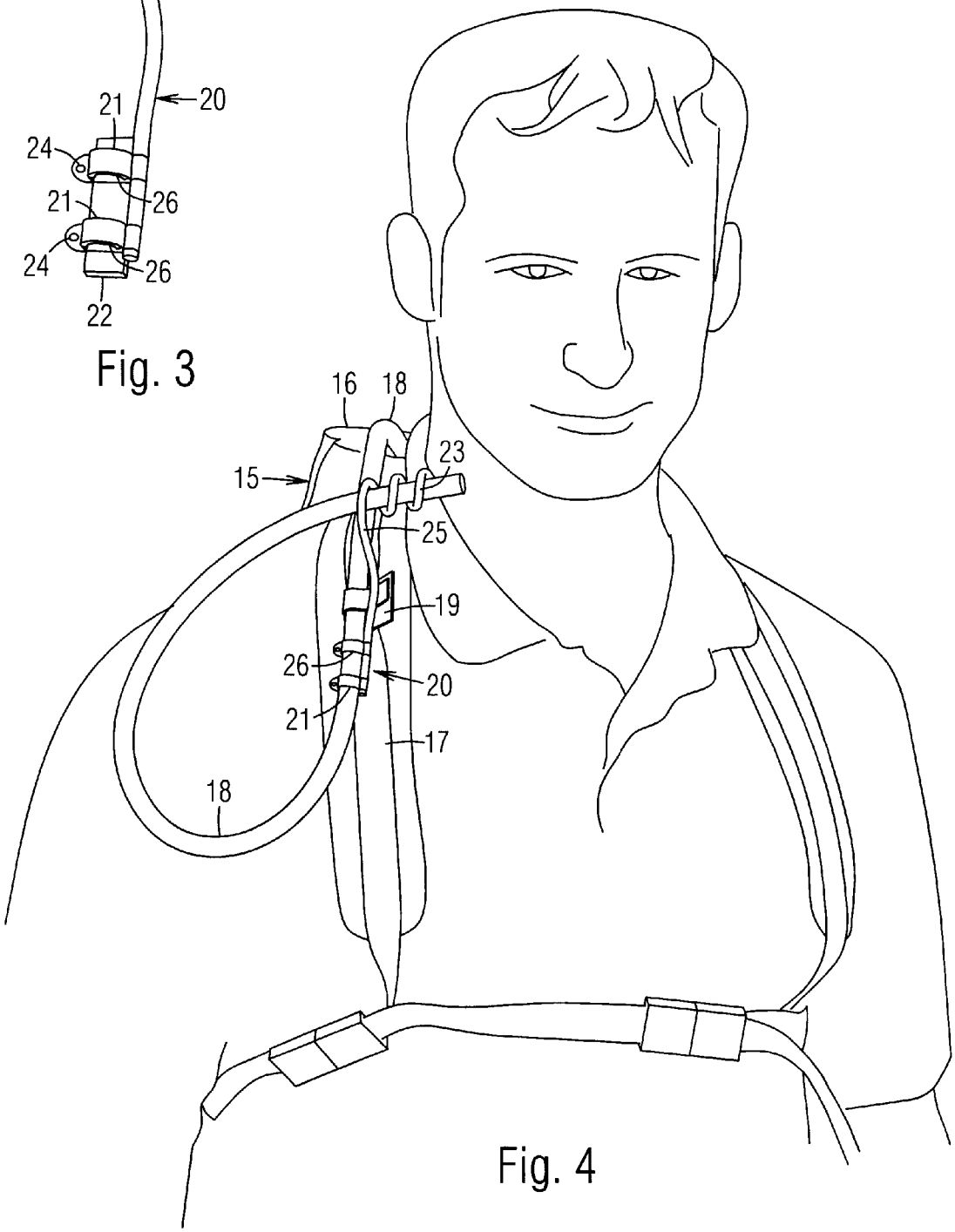
FIG. 4 is a front view of the drinking tube support of FIG. 3 attached to a beverage dispenser.

As shown in FIG. 4, the drinking tube support is attached to beverage dispenser 15 by opening clasps 21, and closing them around drinking tube 18 adjacent clip 19, where drinking tube 18 is stable. Resilient pads 26 ensure a tight fit around drinking tube 18. The free end of drinking tube 18 is inserted through coil 23. Intermediate portion 25 is adjusted by bending until the end of drinking tube 18 is positioned near the mouth of the user. Intermediate portion 25 is preferably long enough to enable drinking tube 18 to be adjusted through a wide range of positions.

Figure 5:
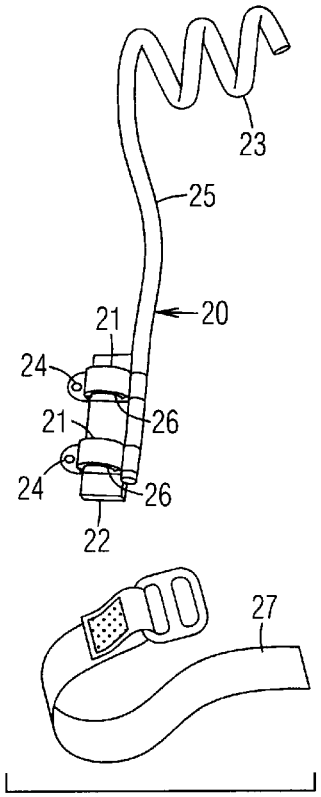
FIG. 5 is a front view of a third embodiment of the drinking tube support.

FIGS. 5–6:

A third embodiment of the drinking tube support is shown in the front view in FIG. 5. It comprises a bendable wire 20 with a lower portion attached to a pair of clasps 21, which are attached on top of a flexible base member 22. A resilient pad 26, preferably felt, is attached to the inside of each clasp 21. An upper end of wire 20 is formed into a coil 23. Clasps 21, which are preferably plastic, are closed with snaps 24. Wire 20 includes a long intermediate portion 25. A retaining strap 27 is also provided.

Figure 6:
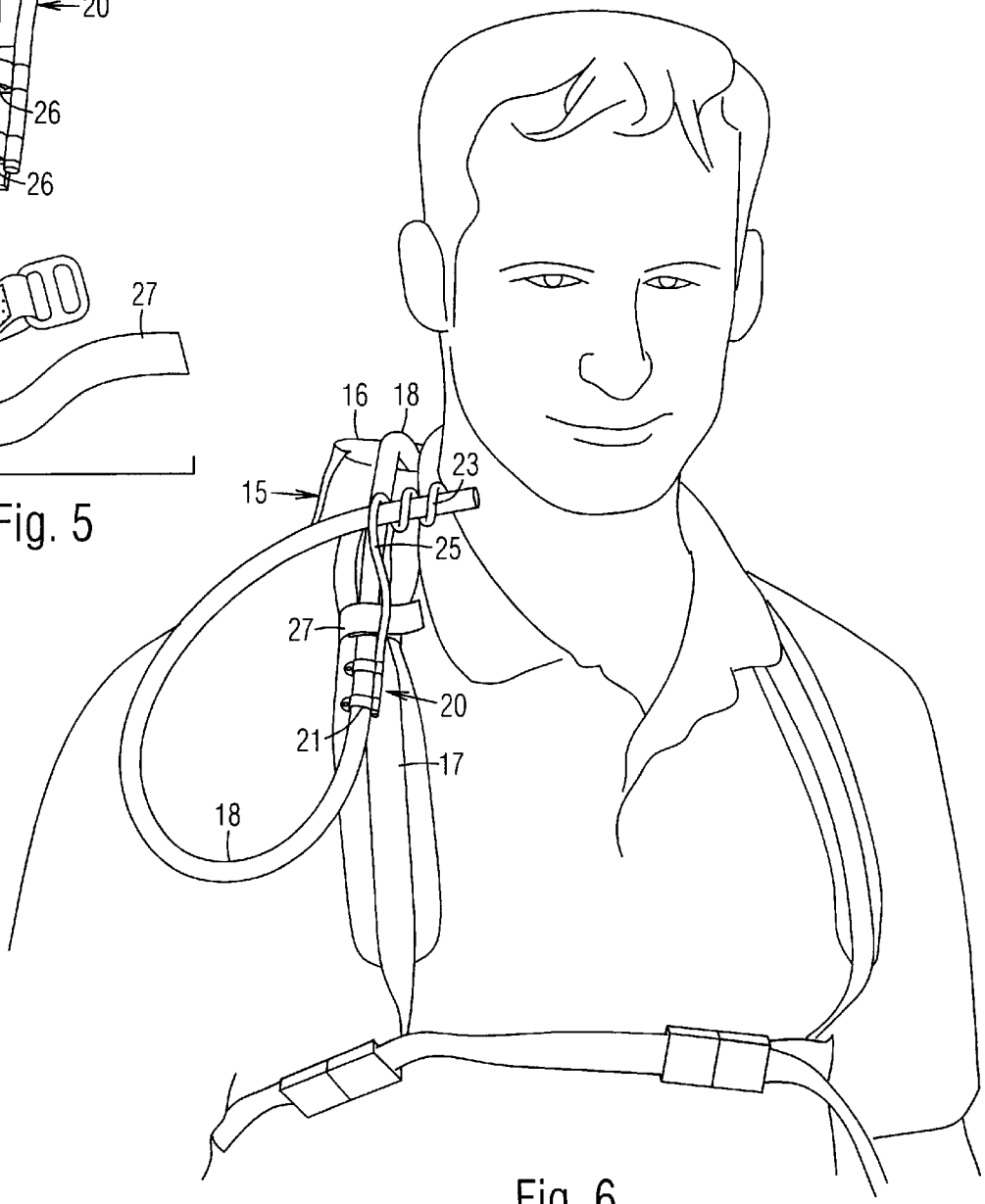
FIG. 6 is a front view of the drinking tube support of FIG. 5 attached to a beverage dispenser.

As shown in FIG. 6, the drinking tube support is attached to beverage dispenser 15 by opening clasps 21, and closing them around drinking tube 18. Resilient pads 26 ensure a tight fit around drinking tube 18. On a beverage dispenser lacking a clip for attaching drinking tube 18 to shoulder strap 17, retaining strap 27 is provided for strapping drinking tube 18 to shoulder strap 17. The free end of drinking tube 18 is inserted through coil 23. Intermediate portion 25 is adjusted by bending until the end of drinking tube 18 is positioned near the mouth of the user. Intermediate portion 25 is preferably long enough to enable drinking tube 18 to be adjusted through a wide range of positions.

SUMMARY AND SCOPE

Accordingly, a drinking tube support for a beverage dispenser has been provided. It supports a drinking tube of the beverage dispenser near the mouth of a user, so that it eliminates the need to pick up the drinking tube. It is adjustable for optimizing the position of the drinking tube, and it can be easily retrofitted to a conventional beverage dispenser by a user.

Although the above description is specific, it should not be considered as a limitation on the scope of the invention, but only as an example of the preferred embodiment. Many substitutes and variations are possible within the teachings of the invention. For example, the intermediate portion of the wire can be of any suitable length long enough to enable drinking tube to be adjusted through a wide range of positions. One wider clasp may be used instead of two narrow ones, so that the base member can be eliminated. The lower end of the wire may be attached to the beverage container instead of the strap. The lower end of the wire may be permanently attached to the beverage dispenser. Instead of a coil, a tubular sleeve can be attached to the top end of the wire for securing the distal end of the drinking tube. The drinking tube support can be attached to other beverage dispensers. The retaining strap may be a hook-and-loop strap, and may be without a buckle. Therefore, the scope of the invention should be determined by the appended claims and their legal equivalents, not by the examples given.

I claim:

1. A drinking tube support in combination with beverage dispenser having a flexible drinking tube and a shoulder strap for strapping onto a person, comprising:

a bendable wire having one end formed into a hook, a portion adjacent said hook formed into a loop attached to said shoulder strap of said beverage dispenser, said hook wrapped around an intermediate portion of said wire securing said loop in a closed position, said wire having an opposite end formed into a coil for wrapping around a distal end of said drinking tube, said intermediate portion of said wire being adjustable by bending for positioning said distal end of said drinking tube near a mouth of said person, said wire retaining a selected shape for keeping said distal end of said drinking tube in a selected position.

2. A drinking tube support in combination with beverage dispenser having a flexible drinking tube and a shoulder strap for strapping onto a person, comprising:

clasp means for clasping onto said beverage dispenser; and a bendable wire having one end attached to said clasp means, and an opposite end formed into a coil for wrapping around a distal end of said drinking tube, an intermediate portion of said wire being adjustable by bending for positioning said distal end of said drinking tube near a mouth of said person, said wire retaining a selected shape for keeping said distal end of said drinking tube in a selected position.

3. The drinking tube support of claim 2, wherein said clasp means comprises a pair of clasps attached in spaced relation on a base member.

* * * * *